United States Patent [19]

Gohara

[11] Patent Number: 4,648,353

[45] Date of Patent: Mar. 10, 1987

[54] FLUIDIZED SAND EXPANSION JOINT

[75] Inventor: Wadie F. Gohara, Barberton, Ohio

[73] Assignee: The Babcock & Wilcox Company, New Orleans, La.

[21] Appl. No.: 739,643

[22] Filed: May 31, 1985

[51] Int. Cl.[4] ..... F22B 13/14

[52] U.S. Cl. ..... 122/4 D; 122/511; 165/82

[58] Field of Search ..... 110/171, 245, 263; 122/4 D, 209 R, 224, 231, 235 D, 235 F, 360, 365, 510, 511, DIG. 11; 165/82

[56] References Cited

U.S. PATENT DOCUMENTS

| | | | |
|---|---|---|---|
| 1,912,043 | 5/1933 | Sanders | 122/235 F |
| 3,685,165 | 8/1972 | Deve | 110/245 X |
| 3,834,328 | 9/1974 | Blazewicz et al. | 110/171 X |
| 3,857,344 | 12/1974 | Coulter | 110/171 X |
| 3,870,099 | 3/1975 | Wolowodiuk | 165/82 |
| 3,893,426 | 7/1975 | Bryers | 122/4 D |
| 4,510,892 | 4/1985 | Wincze et al. | 165/82 X |

*Primary Examiner*—William E. Wayner

*Assistant Examiner*—Steven E. Warner

*Attorney, Agent, or Firm*—Robert J. Edwards

[57] ABSTRACT

An expansion joint is provided between the bottom supported tube walls and the top supported tube walls of a fluidized bed boiler furnace. The expansion joint includes an upwardly open trough having one side and a floor defined by bent portions of the bottom supported tube wall, and another side wall defined by a refractory lined steel plate. A knife edge or sealing projection is connected to an outwardly bent portion of the top supported tube wall and extends downwardly through the upward opening of the trough and into the spaced defined by the trough. The trough is filled with sand or other inert granular material which partially covers the knife edge. The knife edge is in the form of a tube wall with tubes having lower perforations. Fluidizing gas can be supplied into the knife edge to fluidize the sand around the lower end of the knife edge to permit movement of the knife edge in the sand as the top and bottom supported tube walls expand. A satisfactory seal is provided by maintaining a suitable height of the sand covering the knife edge.

10 Claims, 9 Drawing Figures

FLUIDIZED SAND EXPANSION JOINT

BACKGROUND OF THE INVENTION

The present invention relates in general to the construction of large boilers, and in particular to a new and useful expansion joint which establishes a seal between the interior and the exterior of a boiler furnace and which includes a trough containing fluidizable sand or other suitable fluidizable granular materials.

Large fluidized bed combustors or large boilers of greater than about 600 megawatts, must be bottom and top supported. A prior art solution to this support problem includes the formation of an expansion joint in the boiler tubes which comprises a substantially U-shaped portion of each tube projecting outwardly from the furnace walls by 6 to 8 feet. However, this awkward and expensive approach may not perform satisfactorily.

U.S. Pat. No. 2,840,043 to Durham teaches the use of a seal at the bottom of a boiler furnace which includes a flange depending from a wall of the furnace, and the flange extends into liquid held in a container which is supported on a refractory enclosure. While water is used as the liquid for establishing the seal in Durham, this is only appropriate where the water would not be exposed to excessive heat. According to Durham heat is not collected in the region along the top border of the bottom supported boiler portion, the latter being lined with refractory brick which keeps the water cool. A relatively high water level is also necessary in Durham, for example 2 feet. This level is necessary to provide an adequate seal. It is noted that a substantial seal is required to prevent leakage during changes in furnace pressure.

The bed area of a utility size fluidized bed boiler (greater than about 600 megawatts) is large thereby making it difficult to top support the unit unless several small beds are stacked. Stacking the beds, however, leads to an increase in the overall boiler height, and requires a start-up compartment for each bed which adds to the overall area. In addition, start-up compartments with heating surface will require complex ductwork, while compartments without heating surface will increase overall bed area and also require complex ductwork. This will impose some limitations on the gas velocity and dimensions of the convection pass.

In order to couple a one level (ranch style) bottom supported bed with a top supported convection pass, it is necessary to use an expansion joint to allow for free movement of the expanding ends during the heating process of the boiler. The expansion joint must provide the means for expansion, maintain a good seal around the unit, be simple in structure, particularly around the corners, withstand the high furnace temperatures and occupy a small space around the boiler in the horizontal and vertical planes.

References which are relevant to the present invention are U.S. Pat. No. 1,912,043 to Sanders which shows a pulverized fuel fired furnace and its support structure; U.S. Pat. No. 3,893,426 to Bryers which shows a heat exchanger that utilizes an adjoining fluidized bed; U.S. Pat. No. 3,857,334 to Coulter which shows a furnace seal that includes a liquid containing trough; and U.S. Pat. No. 3,685,165 to Deve which shows the fluidization of sand for its reclamation, the sand being used for foundry core molding.

SUMMARY OF THE INVENTION

The present invention is drawn to a support and sealing arrangement for the furnace of fluidized bed boilers, and in particular to utility size boilers. An expansion joint is provided which comprises a trough containing fluidizable, preferably inert, solid granular material such as sand, limestone or spent bed material. The trough is formed at least partly by bent water cooled tube walls, preferably the bottom supported part of the boiler, and partly by a refractory lined steel plate. A knife edge in the form of a tube wall construction extends into the fluidizable granular material. The bottom of the knife edge tube wall is perforated so that fluidizing medium can be bubbled into the granular material. This permits movement of the knife edge in any direction in the granular bed, which movement compensates for expansion of the boiler tube walls.

A top supported tube wall above the trough has an outwardly bent portion with respect to the interior of the furnace, which supports the knife edge and which carries a shield made of refractory lined steel plate that cooperates with a skirt on an interior wall of the trough to resist the entry of flue gas and elutriated material from the interior of the furnace into the trough.

Accordingly, an object of the present invention is to provide an expansion joint for a boiler having a first part which moves with respect to a second part due to expansion, comprising a trough defining an upwardly open space, the trough being connected to one of the boiler parts, a sealing projection extending downwardly through the upward opening of the space and into the trough, the sealing projection being connected to the second part of the boiler, fluidizable solid granular material in the trough and at least partly covering the sealing projection, and fluidizing medium supply means connected to the sealing projection for supplying fluidizing medium into the granular material to fluidize it and permit relative movement between the trough and the sealing projection.

A further object of the present invention is to provide an expansion joint which utilizes fluidizable solid granular material both to accommodate movement and expansion of the first and second boiler parts and also to establish a seal between the interior and the exterior of the boiler.

A still further object of the invention is to provide an expansion joint which also performs a sealing function for a fluidized bed combustor of a boiler, the joint includes a skirt connected to an interior wall of the trough and a shield connected to the second part of the boiler, the shield cooperates with the trough for shielding the upward opening of the trough space and thus protecting the granular material.

A still further object of the invention is to utilize sand, limestone, spent bed material or other inert material as the solid granular material for the trough.

According to the invention, the first boiler part is preferably the bottom supported tube walls of the boiler. The bottom supported tube walls form either an interior or an exterior wall of the trough as well as the floor of the trough, with the opposite wall of the trough being formed by a refractory lined steel plate.

The second part of the boiler is preferably the top supported tube walls which carry the sealing projection and further carry the shield for shielding the upward opening of the trough space. The sealing projection is preferably in the shape of a knife edge formed of a tube wall which can be supplied with fluidizing medium from a header, acting as the fluidizing medium supply means. The lower ends of the tubes making up the knife edge tube wall are perforated for distributing fluidizing medium to the granular material in the trough.

Another object of the invention is to provide an expansion joint for a boiler which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
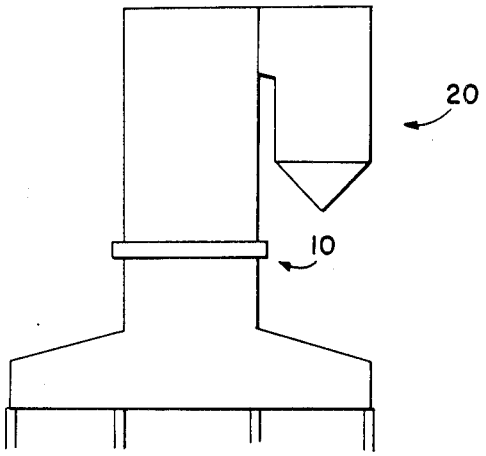
FIG. 1 is a schematic side elevational view of a fluidized bed boiler which utilizes the expansion joint of the present invention.

Referring to the drawings in particular, the present invention comprises an expansion joint and seal generally designated 10 in FIG. 1 for the combustor of a fluidized bed boiler generally designated 20.

Figure 2:
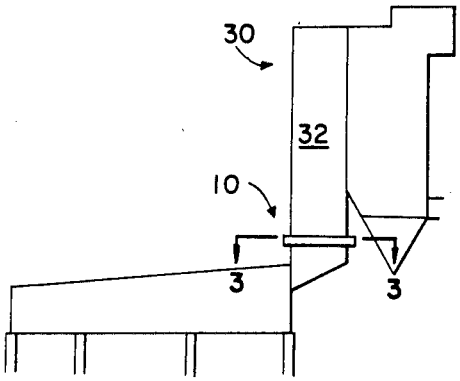
FIG. 2 is a view similar to FIG. 1 of an alternate boiler construction which can also be used in conjunction with the present invention.

FIG. 2 shows the use of seal 10 in a boiler 30 having a different configuration.

Figure 3:
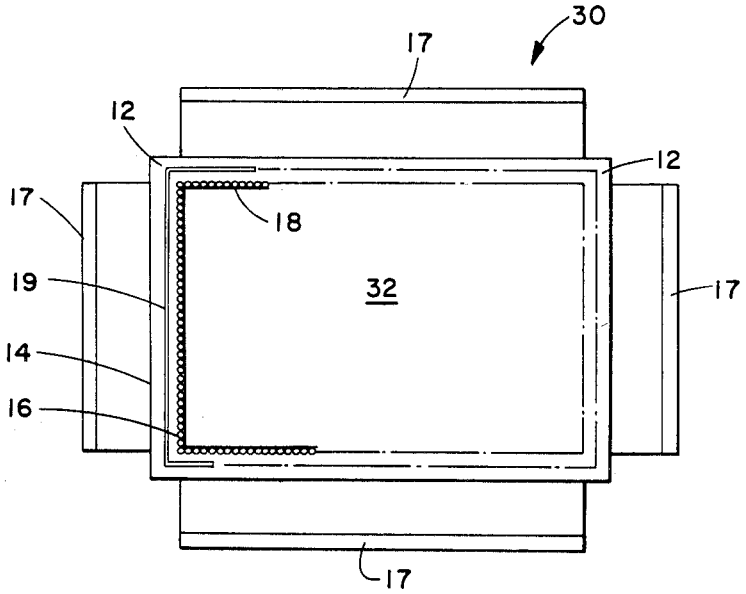
FIG. 3 is a horizontal sectional view taken along line 3—3 of FIG. 2 showing some details of the inventive expansion joint.

FIG. 3 which is taken along the line 3—3 of FIG. 2, shows the expansion joint to include a trough generally designated 12 which extends around the interior 32 of the fluidized bed furnace. Trough 12 is upwardly open and bounded on its exterior by an outer trough wall 14 made of refractory lined steel plate. Trough 12 is bounded on its interior and floor by a bent portion of a bottom supported tube wall 16. A refractory lined steel plate shield 18 which is carried on a top supported tube wall of the boiler 30 is disposed inwardly of the trough 12 and serves to shield the upward opening of the trough. The top supported tube walls are connected to headers 17 which are provided on the ends and sides of the boiler furnace.

Also depending from the top tube sheet is a knife edge 19 which extends downwardly through the upward opening of trough 12 and into the space defined by the trough. In accordance with the invention the trough 12 is filled with preferably inert, solid granular material such as sand which, at least partly, covers the lower end of knife edge 19.

Figure 5:
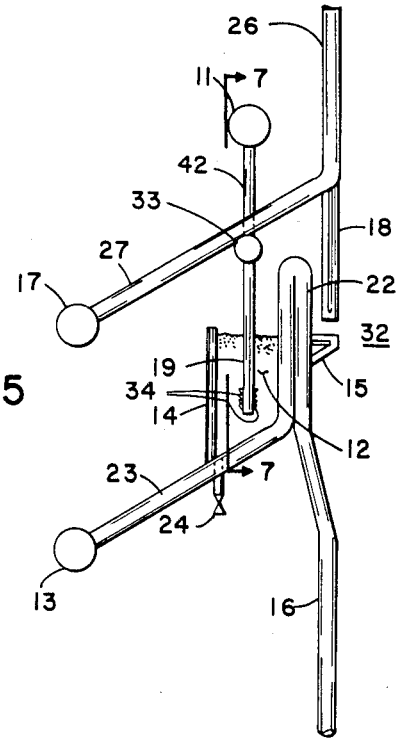
FIG. 5 is a view similar to FIG. 4 showing the expansion joint when the boiler is hot and its parts have expanded.
Figure 4:
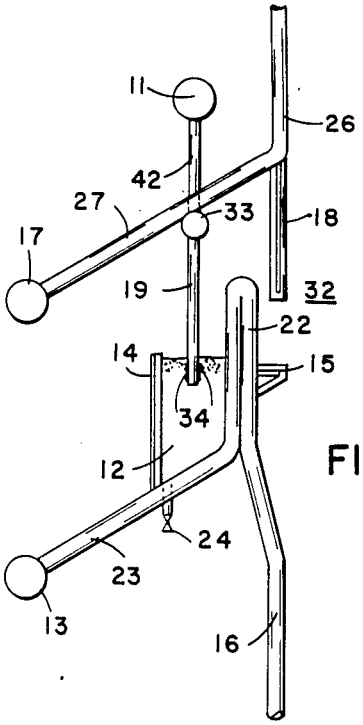
FIG. 4 is a partial side elevational view showing details of the expansion joint when the boiler furnace is cold.

Turning now to FIGS. 4 and 5 which represent the vertical sectional views through the trough area, the top supported tube sheet 26 is shown with an outwardly bent lower portion 27 that extends out of the furnace space 32 and connects the top supported tube wall to the header 17. Shield 18 is connected, for example, by welding to a lower end of the tube wall 26 just before the bent area 27 and extends downwardly therefrom.

The inner and bottom areas of trough 12 are shown bounded by the bottom supported tube wall 16 which has an upper bent portion 22 forming the inner side of trough 12, and a lower, outwardly bent portion 23 forming the bottom of trough 12. The outwardly bent portion 23 of the bottom supported tube wall 16 is connected to a header 13 which is below the header 17 for the top supported tube wall. A skirt 15 which is made of refractory lined steel is connected to the upper bent portion 22 of the bottom supported tube wall 16 and cooperates with the shield 18 to resist the entry of flue gases and fluidized materials from the furnace space 32 into the trough 12.

The outwardly bent portion 23 of the bottom supported tube wall 16 is inclined downwardly to form an inclined bottom for the trough 12. An outlet drain and valve combination 24 is provided at the lower portion of trough 12 for discharging sand or other granular material from the trough space.

Figure 7:
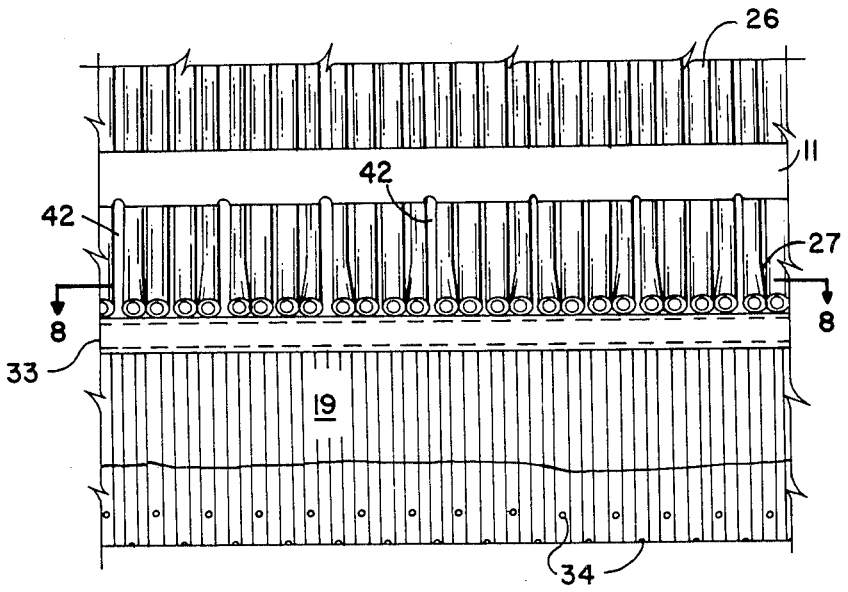
FIG. 7 is a partial vertical sectional view taken along line 7—7 of FIG. 5.
Figure 8:
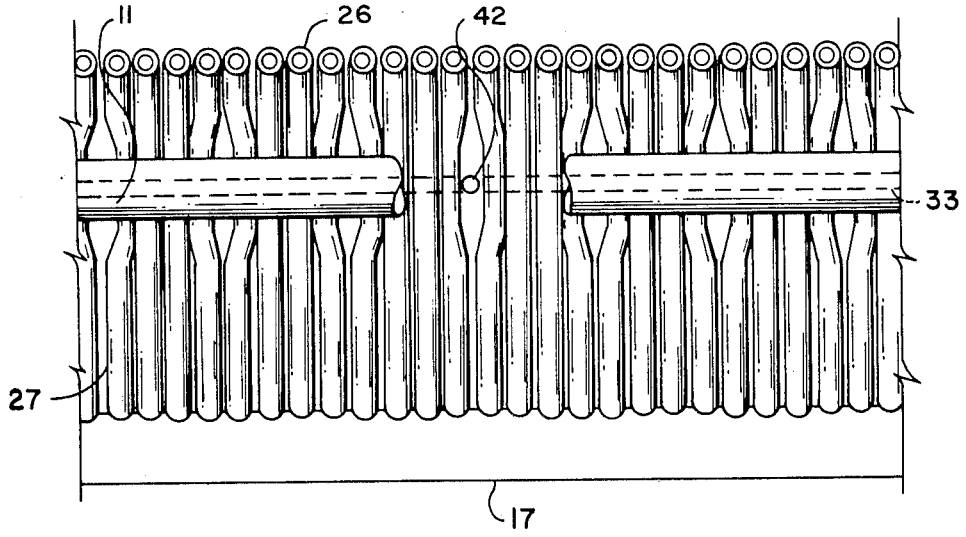
FIG. 8 is a top plan view taken along line 8—8 of FIG. 7, with a portion of a lower header removed for clarity.

The knife edge 19 forms a sealing projection which depends from the outwardly bent portion 27 of the top supported tube wall 26. As best shown in FIG. 7 and 8, the knife edge or sealing projection 19 is made of a tube wall with tubes being connected at their upward end to a small gas header 33. Each of the tubes of knife edge 19 includes, at its lower end, a plurality of perforations 34 which form gas distribution nozzles of the knife edge 19.

Fluidizing gas is supplied to a main gas header 11 which is connected to the small gas header 33 by a plurality of gas tubes 42. As shown in FIG. 8, gas tubes 42 extend between tubes of the tube wall portion 27.

FIG. 4 shows a cold state of the boiler before it begins operation. The bottom and top supported tube walls 16 and 26, forming first and second parts of the boiler, are in an unexpanded and neutrally separated position. The boiler is then started up and as the temperature rises the first and second boiler parts expand and move in three mutually orthogonal directions. The inventive expansion joint can compensate for all three directions of movement while at the same time maintaining a satisfactory gas seal between the interior of the furnace 32 and the exterior thereof.

During expansion of the boiler, fluidizing gas is supplied to the header 11 and distributed through gas tubes 42 to the small gas header 33. This in turn distributes fluidizing medium to the tubes of knife edge 19 and through the perforation 34. This fluidizes at least a portion of the sand adjacent the knife edge to permit the knife edge to move freely through the sand filled trough in any direction. FIG. 5 shows the fully expanded condition of the bottom and top supported tube walls. As is also evident from FIG. 5, shield 18 has approached skirt 15 to better minimize the leakage of gases and other material from the furnace space 32 into the trough 12.

This is because the gases and particles can flow under less resistance in the furnace space 32 then through the space between the shield and skirt. After maximum expansion has been reached, the fluidizing gas can be reduced to a minimum or stopped completely. The height of the sand in the trough 12 is selected to overcome any expected fluctuations in operating boiler pressure.

Figure 6:
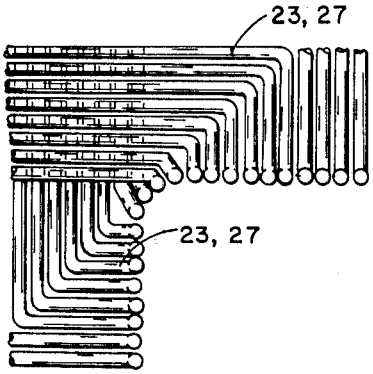
FIG. 6 is a top plan view of a corner area of FIG. 3 showing the distribution of tubes from the tube walls in the corner area.

FIG. 6 shows the configuration of tubes for the outwardly bent portion of both the top and the bottom supported tube walls at the corner areas of the furnace. The tubes from adjacent walls are bent to cross over each other and end into the appropriate header of the neighboring wall. The bent portions 23 and 27 of the bottom and top supported tube walls are bent at an angle of from 60 to 70 degrees with respect to the vertical.

Advantages of the present invention include the fact that the expansion joint is easily manufactured, does not occupy a large amount of space and is simple in construction even around the boiler corners. It is noted that the sand of trough 12 can be replaced by granulated limestone, spent bed material or any other inert solid granular substance.

Bottom supporting the unit as in the present invention allows the use of a one level or ranch style arrangement which leads to shorter units and a fewer number of start up components, related equipment and accessories. Bubbling the fluidizing gas through the knife edge 19 will fluidize the solid granular material surrounding the blade immediately while the rest of the bed is slumped, forming a firm seal. Also the amount of gas required for fluidizing is kept down to a minimum. The tube wall construction of the knife edge provides it with rigidity and support.

Figure 9:
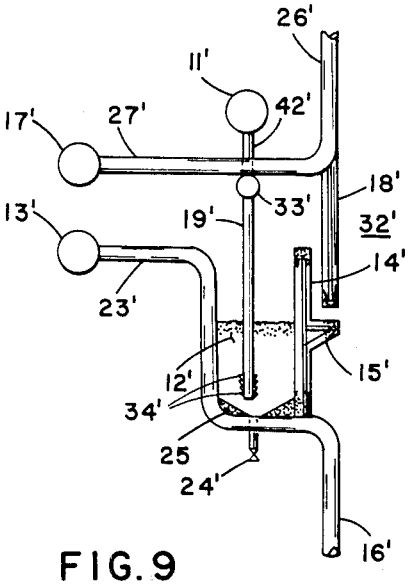
FIG. 9 is a view similar to FIG. 5 but showing another embodiment of the invention.

FIG. 9 shows an alternate construction of the inventive expansion joint where similar elements are designated with the same reference numeral but with the addition of a prime. In that embodiment the inner trough wall extends around the combustion furnace 32' and is formed by refractory lined steel plate 14' and carries skirt 15'. The top and bottom supported tube walls 26', 16', include bent areas 27', 23' which are bent at 90 degrees to the vertical and which are respectively connected to headers 13' and 17'.

The knife edge 19' with its perforations 34', its small header 33', its connecting gas tubes 42' and its main header 11', remain unchanged from the embodiment shown in FIGS. 4 and 5.

The bent portion 23' of the bottom supported tube wall 16' forms a flat bottom as well as a vertical outer wall for trough 12'. To provide an inclined bottom to the trough 12', refractory material 25 is added at the bottom of the trough to facilitate the discharge of sand or other granular material through the drain and valve assembly 24'.

While specific embodiments of the invention have been shown and described in detail to illustrate the application of the principles of the invention, it will be understood that the invention may be embodied otherwise without departing from such principles.

I claim:

1. An expansion joint for a boiler having a first part which moves with respect to a second part due to expansion, comprising;

a trough defining an upwardly open space, said trough adapted to be connected to the first part of the boiler, said trough having one side wall comprising a bent portion of a bottom supported tube wall, said bottom supported tube wall forming the first part of the boiler, said bent portion of said bottom supported tube wall defining a bottom of said trough, said trough having an opposite side wall comprising a refractory lined steel plate connected to said bent portion of said bottom supported tube wall;

a sealing projection extending into the trough space and adapted to be connected to the second part of the boiler, said sealing projection comprising a sealing tube wall made of a plurality of connected tubes;

fluidizable solid granular material in said trough space and partly covering said sealing projection; and fluidizing medium supply means connected to said sealing projection for supplying fluidizing medium into said granular material to fluidize at least a portion of said granular material adjacent said sealing projection for permitting relative movement of said sealing projection with respect to said trough whereby a support and seal can be maintained between said projection and said trough during relative movement between the first and second parts of the boiler, said fluidizing medium supply means comprising a header connected to an upper end of said tubes and said tubes including perforations at lower ends thereof for supplying fluidizing medium into said granular material.

2. An expansion joint according to claim 1, wherein an inner wall of said trough is defined by said bent portion of said bottom supported tube wall and an outer wall of said trough is defined by said refractory lined steel plate.

3. An expansion joint according to claim 1, wherein an outer wall of said trough is defined by said bent portion of said bottom supported tube wall and an inner wall of said trough is defined by said refractory lined steel plate.

4. An expansion joint according to claim 1, wherein said fluidizable solid granular material is selected from the group consisting of sand, granulated limestone and granulated spent refractory material.

5. An expansion joint according to claim 1, including a skirt connected to an inner wall of said trough and adapted to extend inwardly of the boiler, and a shield adapted to be connected to and extending downwardly from the first part of the boiler for cooperating with the skirt for resisting the entry of material from the boiler into the trough.

6. An expansion joint according to claim 5, wherein the bottom of said trough is inclined toward a low point and including drain means connected at said low point for discharging granular material from said trough space.

7. An expansion joint according to claim 6, including a top supported tube wall forming the second part of the boiler, said top supported tube wall having an outwardly bent portion connected to and supported by said sealing projection, said shield comprising a refractory lined steel plate connected to a portion of said top supported tube wall.

8. An expansion joint according to claim 7, wherein said bent portion of said top and bottom supported tube walls extend at least in part at 60 to 70 degrees with respect to the vertical and in a direction outwardly of the interior of the boiler.

9. An expansion joint according to claim 8, wherein said bent portion of said bottom supported tube wall forms an inner wall of said trough which is connected to said skirt, said skirt comprising refractory lined steel.

10. An expansion joint according to claim 6, wherein said bent portion of said bottom supported tube wall comprises the bottom and the outer wall of said trough, said trough containing inclined refractory material defining the low point of said trough and supported on the bent portion of said bottom supported tube wall.

* * * * *